United States Patent [19]

Jette

[11] Patent Number: 4,561,392

[45] Date of Patent: Dec. 31, 1985

[54] GIRDLE ASSEMBLY FOR STUD MOUNTED ROCKER ARMS

[75] Inventor: Paul M. Jette, Pasadena, Calif.

[73] Assignee: Del West Engineering, Inc., Chatsworth, Calif.

[21] Appl. No.: 649,229

[22] Filed: Sep. 10, 1984

[51] Int. Cl.[4] ..... F01L 1/22

[52] U.S. Cl. ..... 123/90.43; 123/90.54

[58] Field of Search ..... 123/90.41, 90.43, 90.54, 123/90.39

[56] References Cited

U.S. PATENT DOCUMENTS

| | | | |
|---|---|---|---|
| 4,221,199 | 9/1980 | Buuck et al. | 123/90.43 X |
| 4,227,494 | 10/1980 | Vitvlugt | 123/90.43 X |
| 4,337,738 | 7/1982 | Bubniak et al. | 123/90.43 X |
| 4,411,229 | 10/1983 | Curtis et al. | 123/90.43 X |

*Primary Examiner*—William R. Cline
*Assistant Examiner*—Peggy A. Neils
*Attorney, Agent, or Firm*—Lewis Anten; Robert B. Block

[57] ABSTRACT

A girdle assembly for stud mounted rocker arms particularly adapted for use in racing engines wherein it is desired to unify the valve stud structure to prevent stud fatigue failure and adverse harmonics. The valve adjustment mechanism is provided by barrel nuts and locking studs. The barrel nut is externally threaded to accept a lower spherical seating nut on which the girdle rests in counter-bored spherical recesses which mates with the seating nuts. The bar is locked in place and the girdle assembly secured as a unitary structure by bearing washers and lock nuts engaging the upper surface of the bar and urging it into rigid contact with the seating nuts. After assembly and tightening, the girdle assembly need not be loosened or disassembled for valve adjustment, but, the latter can be carried out by adjusting the barrel nuts right through the girdle assembly while the latter is fully tightened.

4 Claims, 8 Drawing Figures

GIRDLE ASSEMBLY FOR STUD MOUNTED ROCKER ARMS

BACKGROUND OF THE INVENTION

The present invention relates to apparatus for stabilizing the rocker arm assembly of stud mounted rocker arm designs in internal combustion engines operating at high RPM, i.e., from 5000 rpm to 7000 rpm and above. The invention is applicable to both lifter type and overhead cam type engines that employ stud mounted rocker arms.

Stud mounted rocker arm assemblies have been adapted for many high performance, high rpm engines, particularly those used in racing. Without stabilization, stud mounted rocker arm are often subject to premature fatigue failure. Even when failure does not result, adverse harmonic vibrations spoil engine performance. Races have been lost to this problem since these parts cannot be replaced within the time constraints of the racing situation. Furthermore, even where stud girdles have been used they have not functioned well at very high rpms resulting in rough engine performance or difficult adjustment.

Heretofore, girdle bars and plates have been clamped sidewise to several of the studs at once in order to distribute vibration and to tie the rocker arm structure together. Such girdle bar mechanisms are shown in U.S. Pat. No. 3,870,024 to Ridgeway, issued Mar. 22, 1975 and U.S. Pat. No. 3,430,612 to Anseth issued Mar. 4, 1969.

Both of these reference patents propose a mechanical arrangement in which a clamp is formed by squeezing a pair of girdle bars partially encircling the studs with a small gap between the girdle bars with a set of screws operating intension. This causes the included girdle pairs to clamp the studs laterally, i.e., normal to the axis of the stud. In the so-called Chevy V-8 heads, the studs are aligned parallel and in the same plane which makes for relatively simple machining of the recesses for such prior girdles. However, in the Ford V-8 head the valves are canted and splayed so that there is no common alignment. Economic machining of a girdle for such an arrangement has not been possible not only due to the required resetting and rejigging of the machine tools, but also because the installation becomes too critical.

The designs of U.S. Pat. Nos. 3,430,612 and 3,870,024 references rely on screws in tension for the clamping forces. As known, tensioned screws have considerable yield and the result is not fully effective as the operating forces increase. In most cases, moreover, the removal of the girdle, which must be done several times before each race, requires several very inconvenient and time-consuming steps; requires the use of both of the mechanic's hands, one to back the other end of the screw while the first is removed. While one handed arrangements appear to be shown in U.S. Pat. No. 3,430,612 they are impractical for other reasons. There is, therefore, a need for a new and improved girdle assembly which will overcome the above limitations and disadvantages.

In general, it is an object of the present invention to provide an improved valve stud girdle which is self-aligning to the studs over a suitable range of positions; uses clamping forces developed without screws tension in the plane of the girdle (lateral to the studs), and which can readily be removed and replaced after being installed.

A further object of the invention is to provide a valve stud girdle of the above character which can be set up, removed and reinstalled in a one-handed operation with high accuracy and in a very short time so as to be suitable for the racing environment.

A further general object is to provide a stud girdle which uses primarily friction forces in a ball socket joint for transmitting and equalizing vibrations and forces among the rocker valve rocker arm studs.

A further general object to provide a valve stud girdle which can readily be adapted by a splitting arrangement to divide the same amongst interspersed rocker arm studs which are canted and splayed, as is Ford Motor car engines.

Further general object of this invention is to provide a valve stud girdle assembly for engine heads which results in fewer stud failures during operation at high rpms than conventional designs.

A further object of the invention is to provide a valve stud girdle which is user-friendly by being easy to install and readily permitting valve adjustments to be made directly through the girdle while the same is fully secured in place.

These and other objects and features of the invention will be apparent from the following description and claims when taken in conjunction with the accompanying drawings, of which:

DETAILED DESCRIPTION OF THE PREFERRED EMBODIMENT

Figure 1:
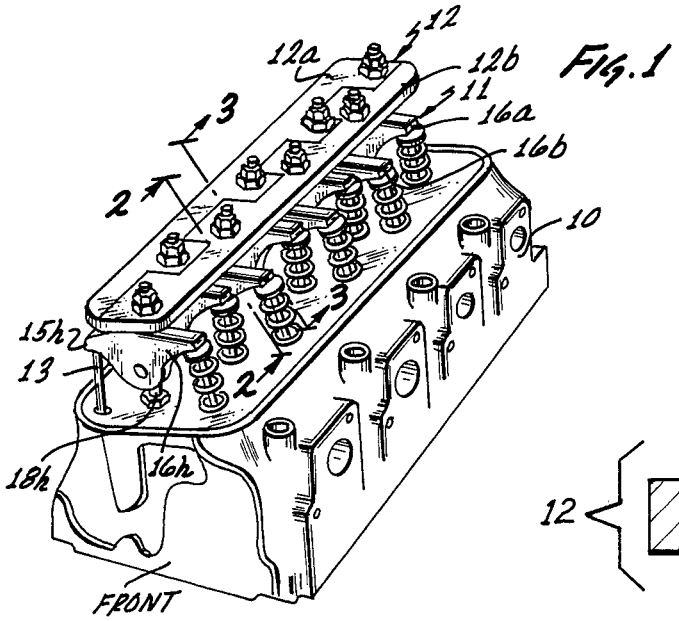
FIG. 1 is an isometric view of a cylinder head, with a girdle assembly installed, constructed in accordance with the present invention for an engine head having canted and splayed rocker arm studs.
Figure 2:
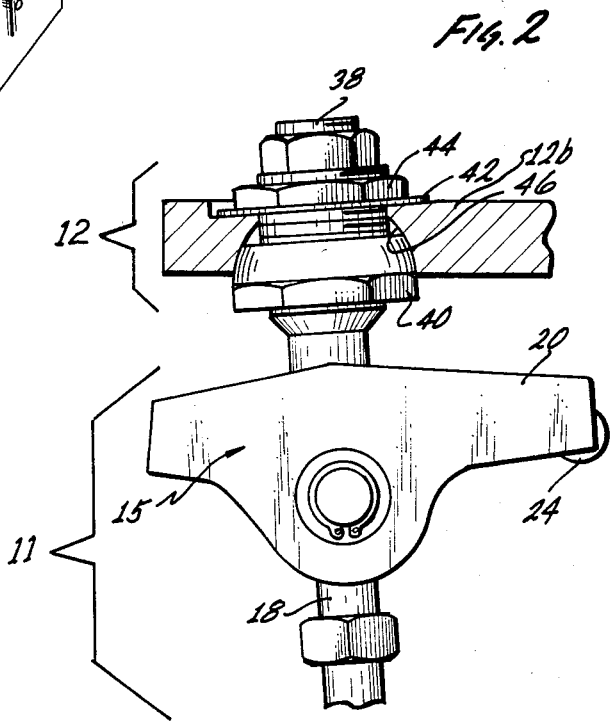
FIG. 2 is an elevational view of the cross section taken along lines 2—2 of FIG. 1.
Figure 3:
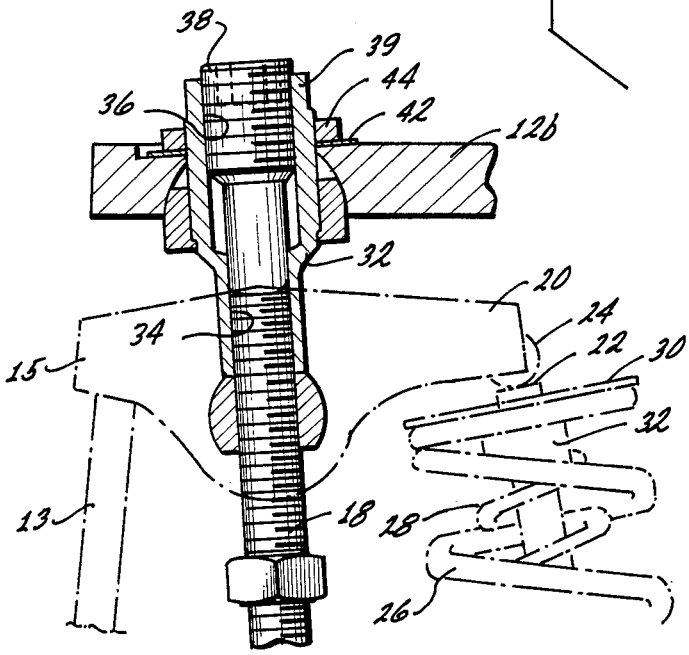
FIG. 3 is a cross-sectional view along the lines 3—3 of FIG. 1.
Figure 4:
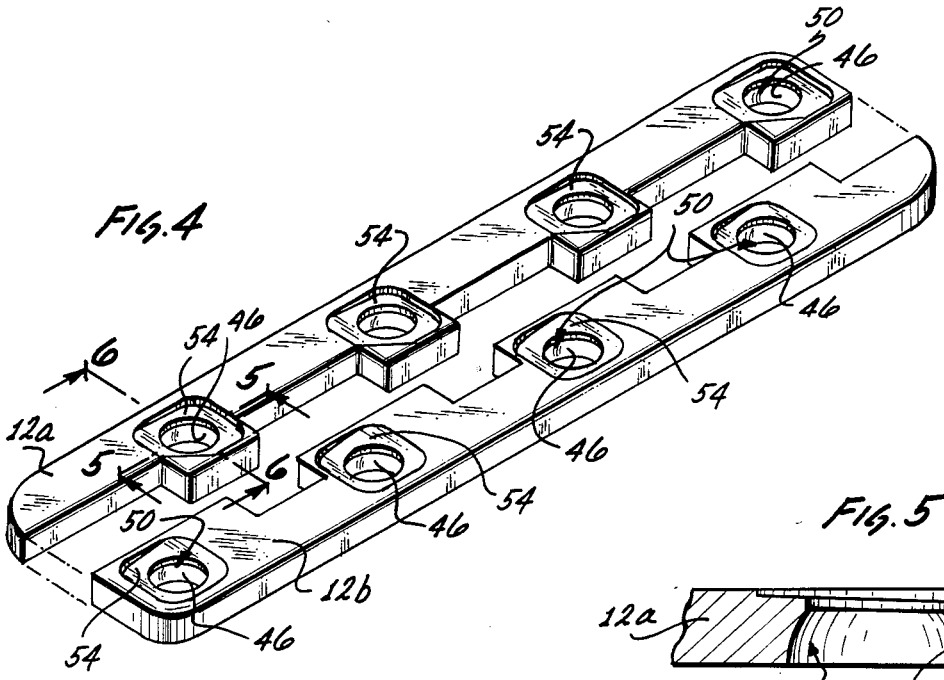
FIG. 4 is an expanded view of the girdle bars of FIG. 1 removed and slightly separated for clarity of illustration.
Figure 5:
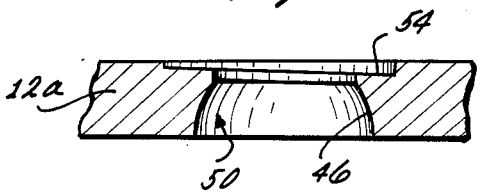
FIG. 5 is a cross-sectional view taken along lines 5—5 of FIG. 4.
Figure 6:
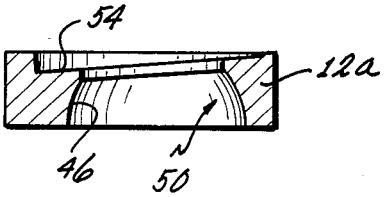
FIG. 6 is a cross-section of the view taken along the lines 6—6 of FIG. 4.
Figure 7:
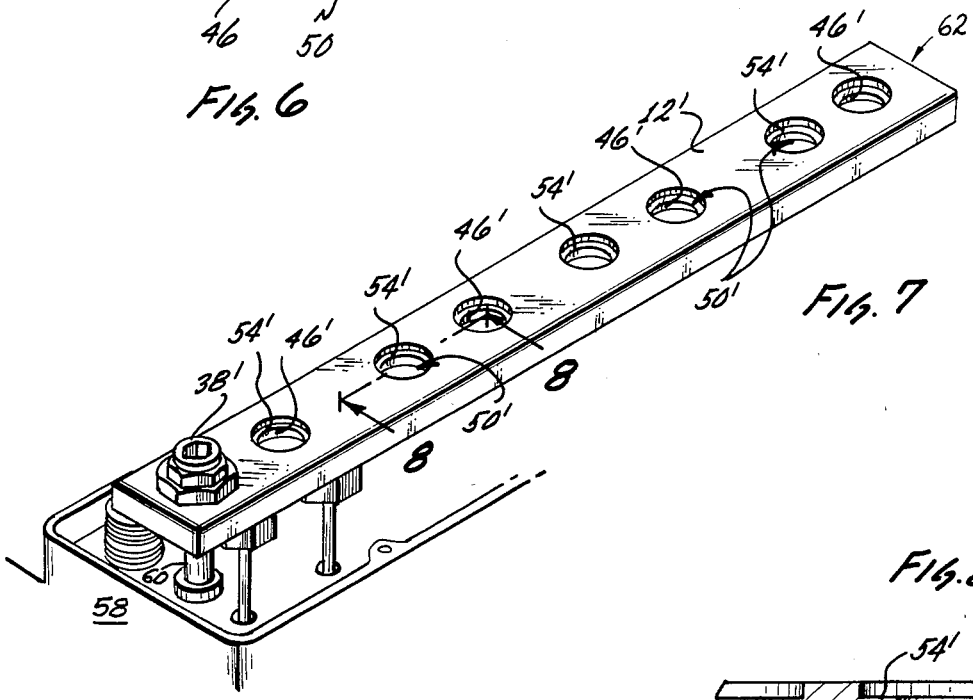
FIG. 7 is an isometric view, partially broken away of an alternate cylinder head and girdle assembly constructed in accordance with the present invention for engine aligned rocker arm studs lying parallel to each other in a common plane.
Figure 8:
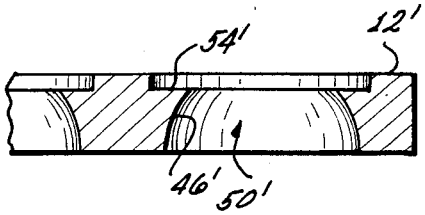
FIG. 8 is a cross sectional view taken along the lines 8—8 of FIG. 7.

Referring now to FIG. 1 there is shown a head 10 on an engine of the Ford V-8 type with the valve in-head rocker arm assembly 11 and girdle bar assembly 12 installed and constructed in accordance with the present invention. As is known, a plurality of push rods 13 extend upwardly through passages in the head and are driven by a cam shaft to make contact with one side 15*a–h* of a set of rocker arms 16*a–h* mounted on a set of rocker arm studs 18*a* . . . 18*h*. As best shown in FIG. 3 the other end 20 of the rocker arms carries a roller bearing which is in driving contact with the stem ends 27 of the valves through a roller cam 24. The valves are 2. A girdle assembly for supporting a set of rocker arm studs as a unitary structure for damping vibrations comprising, barrel means positioned on each stud to adjust valve lash, ball nut means threadedly engaging each said barrel means and having a nut portion at its bottom and upwardly facing ball surface at its top, girdle bar means having holes therethrough for passing the upper end of said studs and barrel means, each said holes opening downwardly into a recess thereabout which mates with the upper surface of said ball nut means, which when adjusted, define a plane within which said girdle bar means is evenly supported, locking nut means threadedly engaging the upper end of said barrel means whereby the ball nut means and locking nut means, when taken up, firmly and directly grip the upper and lower surfaces of said girdle bar means to thereby transform the rocker arm stud set and girdle assembly into a mutually supporting assembly.

3. A girdle assembly for supporting a set of at least three rocker arm studs as a unitary structure for distribution of vibrations therebetween comprising, a rocker arm barrel threaded internally and screwed into place on each stud to adjust valve lash, said barrel having adjustment nut portion at its upper end, a locking stud engaging the barrel interior to its upper end and terminating in an surface adapted to lie in contact with the top of said rocker arm stud, a ball nut threadedly engaging the barrel and having a nut portion on its bottom end and an upwardly facing ball portion on its top forming a surface of a frustrum, a girdle bar means, said girdle bar means having holes therethrough for passing the upper end of said studs and barrels, each of said holes opening downwardly into a recess thereabout which mates with the surface of the frustrum of said respective ball nut, said ball nuts, when adjusted, defining a plane within which said girdle bar means is evenly supported, nut and washer means threadedly engaging the upper end of said barrel nut whereby the ball and barrel nut when taken up firmly and directly grip the upper and lower surface of said girdle, means forming a flat on the upper side of said girdle and surrounding each said hole, said barrel nut and washer clamping the interposed grid plate from its upper and lower surfaces in compression resisted by the tension forces developed in the barrel nut and substantially normal to the plane of the girdle bar means.

4. The girdle assembly as in any of claims 1 through 3 in which said upwardly facing surface is hemispherical.

* * * * *